US008608501B2

(12) United States Patent
Sun

(10) Patent No.: US 8,608,501 B2
(45) Date of Patent: Dec. 17, 2013

(54) ATTACHMENT MECHANISM FOR ELECTRONIC COMPONENT

(75) Inventor: Zheng-Heng Sun, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/426,629

(22) Filed: Mar. 22, 2012

(65) Prior Publication Data

US 2013/0157479 A1 Jun. 20, 2013

(30) Foreign Application Priority Data

Dec. 16, 2011 (CN) ..... 2011 1 0423217

(51) Int. Cl.
*H01R 13/62* (2006.01)

(52) U.S. Cl.
USPC ..... 439/326

(58) Field of Classification Search
USPC ..... 439/326, 328, 329, 331; 361/759, 753, 361/801, 785
See application file for complete search history.

(56) References Cited

U.S. PATENT DOCUMENTS 3,701,071 A * 10/1972 Landman ..... 200/5 R
3,851,294 A * 11/1974 Palazzetti et al. ..... 439/272
4,060,295 A * 11/1977 Tomkiewicz ..... 439/55
5,268,820 A * 12/1993 Tseng et al. ..... 361/785
6,089,876 A * 7/2000 Kuwahara et al. ..... 439/67
6,200,144 B1 * 3/2001 Wark ..... 439/74
6,201,704 B1 * 3/2001 Poplawski et al. ..... 361/753
6,319,037 B1 * 11/2001 Lai ..... 439/327
6,655,976 B1 * 12/2003 Shipe et al. ..... 439/328
6,769,927 B2 * 8/2004 Brewer ..... 439/328
6,971,899 B1 * 12/2005 Liu ..... 439/326
7,004,764 B2 * 2/2006 Boudreau et al. ..... 439/74
7,134,896 B1 * 11/2006 Chen ..... 439/326
7,258,569 B1 * 8/2007 Johnson et al. ..... 439/378
7,294,009 B1 * 11/2007 Peng et al. ..... 439/326
7,300,298 B2 * 11/2007 Kameda ..... 439/326
7,489,523 B2 * 2/2009 Hsu ..... 361/801
7,554,816 B2 * 6/2009 Chang ..... 361/759
7,828,574 B2 * 11/2010 Zhu ..... 439/328
7,850,475 B1 * 12/2010 Feldman et al. ..... 439/328
7,922,506 B1 * 4/2011 Harlan et al. ..... 439/160
7,924,558 B2 * 4/2011 Crippen et al. ..... 361/679.4
7,927,110 B1 * 4/2011 Zhu ..... 439/67
8,295,060 B2 * 10/2012 Liu et al. ..... 361/800
8,303,324 B2 * 11/2012 Franke ..... 439/326
8,408,928 B2 * 4/2013 Won et al. ..... 439/260

FOREIGN PATENT DOCUMENTS

TW M299945 10/2006

* cited by examiner

*Primary Examiner* — Alexander Gilman
(74) *Attorney, Agent, or Firm* — Altis Law Group, Inc.

(57) ABSTRACT

An attachment mechanism for fastening an electronic component includes a circuit board and a fastener. The circuit board includes a first connector to be connected to a second connector of the electronic component. The fastener includes a main body engaging with the first connector and an operation portion extending up from the main body. An engaging bar protrudes from the operation portion to abut against a top of the electronic component.

5 Claims, 5 Drawing Sheets

ATTACHMENT MECHANISM FOR ELECTRONIC COMPONENT

BACKGROUND

1. Technical Field

The present disclosure relates to a mechanism for attaching an electronic component to a device.

2. Description of Related Art

An electronic component in a server, such as an expansion card, is attached to a motherboard. An end of the expansion card is fastened to the motherboard, and a connector at an opposite end of the expansion card is connected to a connector of the motherboard. However, the connection of the connectors may not be solid enough and the expansion card may disengage from the connector of the motherboard, which adversely influences data transmission of the server.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
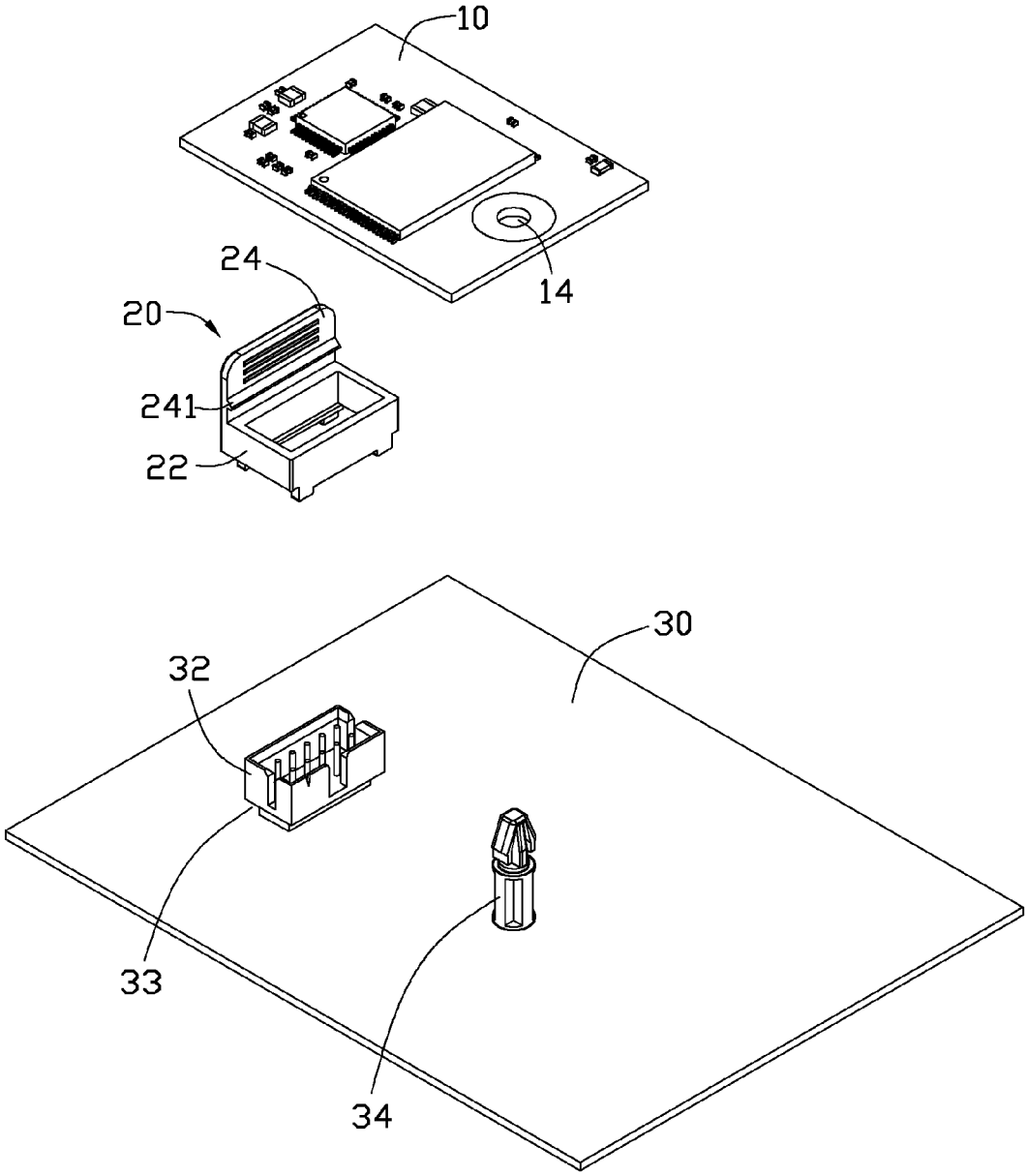
FIG. 1 is an exploded, isometric view of an exemplary embodiment of an attachment mechanism, together with an electronic component, wherein the attachment mechanism includes a fastener.
Figure 2:
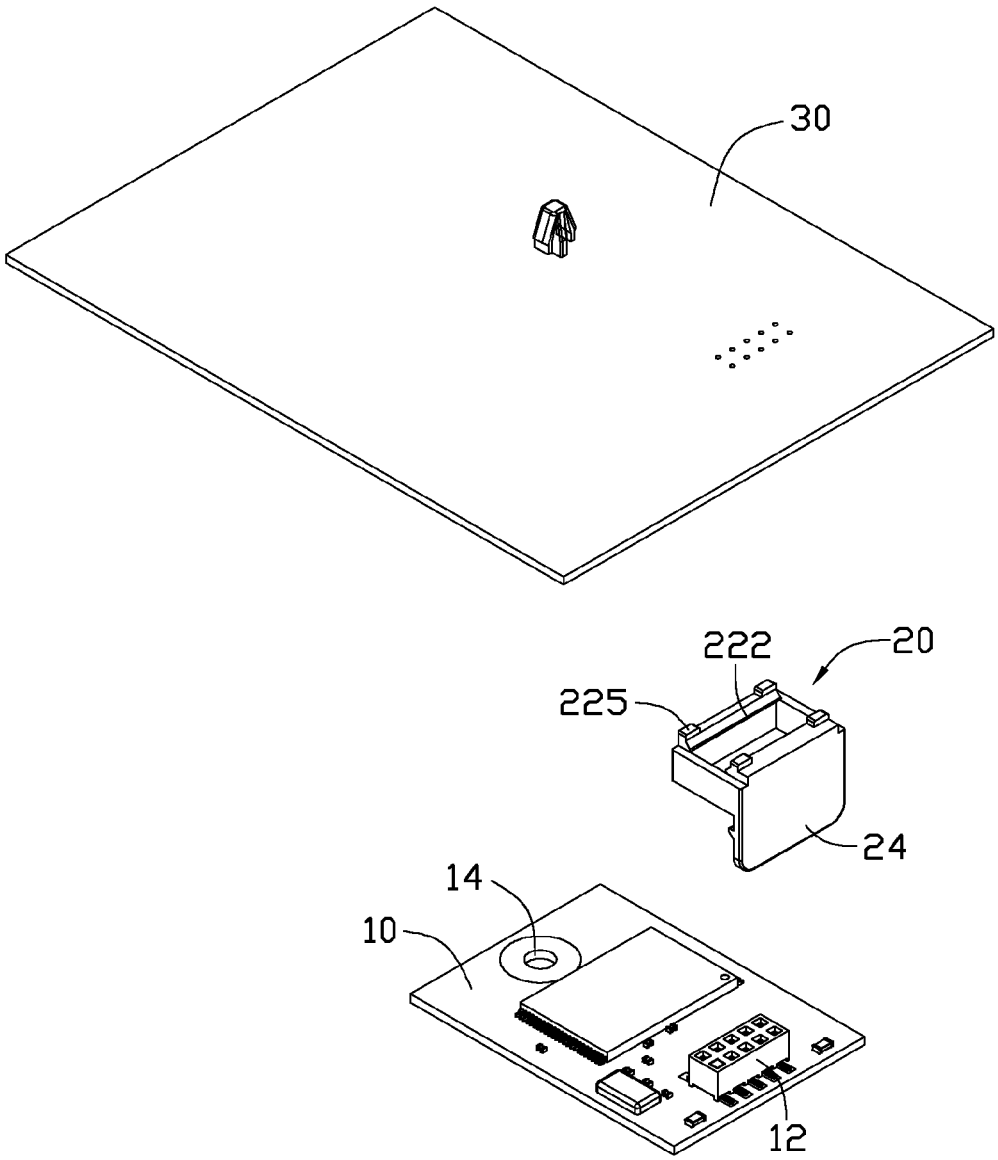
FIG. 2 is an inverted view of FIG. 1.

FIGS. 1 and 2, show an exemplary embodiment of an attachment mechanism for fastening an electronic component 10 including a circuit board 30 and a fastener 20. The electronic component 10 includes a first connector 12 mounted to a first end of a side surface, and defines a through hole 14 in a second end of the electronic component 10 opposite to the first end.

A second connector 32 is fastened to the circuit board 30. Two hooking slots 33 are defined between opposite sides of a bottom of the second connector 32 and the circuit board 30. A hook 34 extends up from the circuit board 30.

Figure 3:
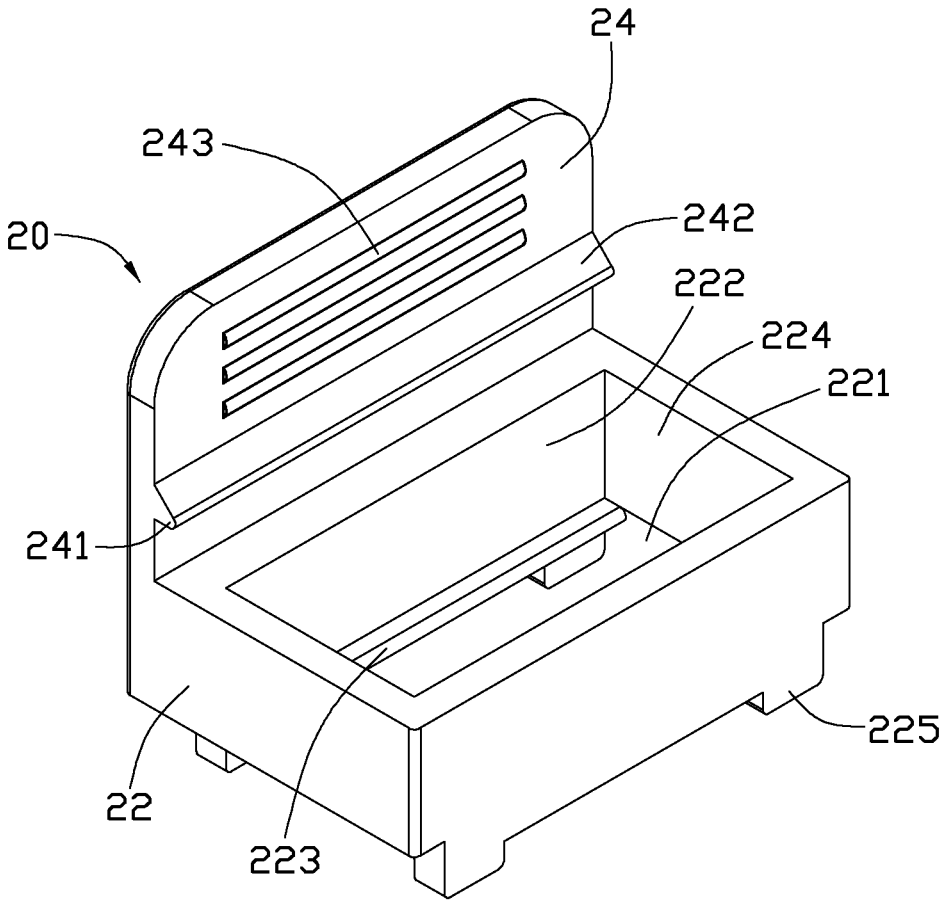
FIG. 3 is an enlarged view of the fastener of FIG. 1.

FIG. 3, shows the fastener 20 includes a rectangular main body 22 and an operation portion 24. The main body 22 includes two opposite sidewalls 222 and two end walls 224 connected between corresponding ends of the sidewalls 222. The sidewalls 222 and the end walls 224 together bound a receiving slot 221. A resilient bar 223 extends from a lower portion of each sidewall 222 toward the other sidewall 222. Two supporting feet 225 extend down from a bottom of each sidewall 222, respectively adjacent to the corresponding end walls 224. The operation portion 24 extends up from an outer side of one of the sidewalls 222 away from the receiving slot 221. A long engaging bar 241 protrudes from an inner surface of the operation portion 24, substantially parallel to a top of the sidewall 222. A guiding surface 242 is formed on a top of the engaging bar 241, extending slantingly down. A plurality of strips 243 protrudes from the inner surface of the operation portion 24, located above the engaging bar 241, for conveniently manipulating the operation portion 24.

Figure 4:
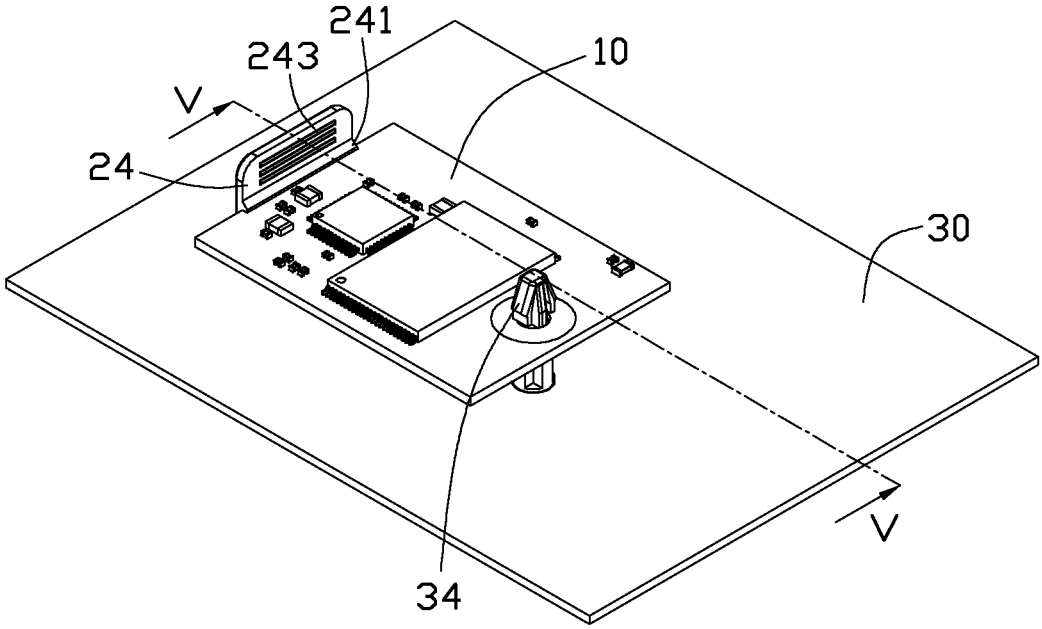
FIG. 4 is an assembled, isometric view of FIG. 1.
Figure 5:
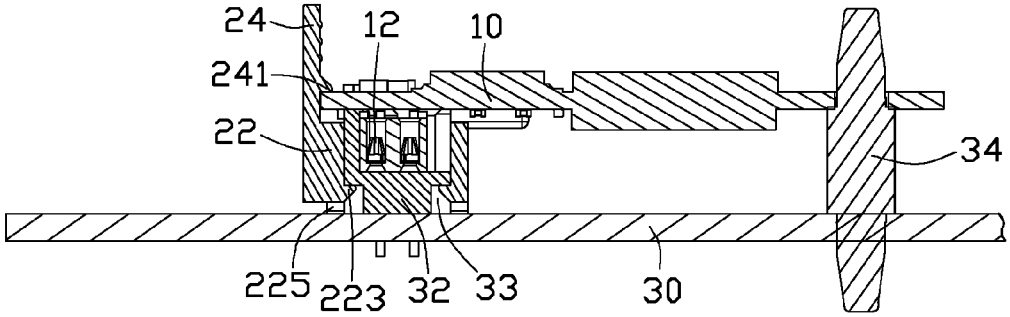
FIG. 5 is sectional view taken along the line of V-V of FIG. 4.

FIGS. 4 and 5, show in assembly, the fastener 20 is placed above the second connector 32, with the receiving slot 221 aligning with the second connector 32. The fastener 20 is manipulated downward; the second connector 32 deforms the resilient bars 223 away from each other. When the supporting feet 225 abut against the circuit board 30, the resilient bars 223 are self-restored to engage in the corresponding hooking slots 33, and abut against top the bottom of the second connector 32.

To fasten the electronic component 10, the first connector 12 is aligned above the second connector 32. The electronic component 10 is manipulated downward. The hook 34 extends through the through hole 14. When the first end of the electronic component 10 abuts against the guiding surface 242, the engaging bar 241 together with the operation portion 24 is deformed away from the electronic component 10. After the first connector 12 is connected to the second connector 32, the operation portion 24 is restored, to allow the engaging bar 241 to abut against the first end of a top surface of the electronic component 10. The hook 34 abuts against the second end of the top surface of the electronic component 10. Therefore, the electronic component 10 is fastened to the circuit board 30.

It is believed that the present embodiments and their advantages will be understood from the foregoing description, and various changes may be made thereto without departing from the spirit and scope of the description or sacrificing all of their materials advantages, the examples hereinbefore described merely being exemplary embodiments.

What is claimed is:

1. An attachment mechanism for fastening an electronic component, comprising:

a circuit board comprising a first connector to be connected to a second connector of the electronic component; and a fastener comprising a main body mounted to the first connector and an operation portion extending up from the main body, an engaging bar protruding from the operation portion to abut against a first end of a top of the electronic component;

wherein the main body defines a receiving slot for receiving the first connector, a hooking slot is defined in a side of the first connector, a resilient bar protrudes from an inner surface of a sidewall bounding the receiving slot to engage in the hooking slot.

2. The attachment mechanism of claim 1, wherein a plurality of supporting feet protrudes down from the main body to abut against the circuit board.

3. The attachment mechanism of claim 1, wherein a plurality of strips protrudes from the operation portion, located above the engaging bar.

4. The attachment mechanism of claim 1, wherein a guiding surface is formed on a top of the engaging bar, slantingly extending down.

5. The attachment mechanism of claim 1, wherein a hook extends up from the circuit board, to engage with a second end of the top of the electronic component.

* * * * *